US011738898B2

(12) United States Patent
Hagestedt et al.

(10) Patent No.: US 11,738,898 B2
(45) Date of Patent: Aug. 29, 2023

(54) DEVICE AND METHOD FOR CUSHIONING AT LEAST ONE OBJECT IN A CONTAINER

(71) Applicant: Storopack Hans Reichenecker GMBH, Metzingen (DE)

(72) Inventors: Lukas Hagestedt, Esslingen (DE); Hasan Faslak, Stuttgart (DE)

(73) Assignee: Storopack Hans Reichenecker GmbH, Metzingen (DE)

( * ) Notice: Subject to any disclaimer, the term of this patent is extended or adjusted under 35 U.S.C. 154(b) by 210 days.

(21) Appl. No.: 16/609,881

(22) PCT Filed: May 7, 2018

(86) PCT No.: PCT/EP2018/061720
§ 371 (c)(1),
(2) Date: Dec. 18, 2019

(87) PCT Pub. No.: WO2018/202914
PCT Pub. Date: Nov. 8, 2018

(65) Prior Publication Data

US 2020/0115087 A1 Apr. 16, 2020

(30) Foreign Application Priority Data

May 5, 2017 (DE) ..... 10 2017 109 736.8

(51) Int. Cl.
*B65B 55/20* (2006.01)
*B65B 57/00* (2006.01)
*B65B 59/00* (2006.01)

(52) U.S. Cl.
CPC ..... *B65B 55/20* (2013.01); *B65B 57/00* (2013.01); *B65B 59/001* (2019.05)

(58) Field of Classification Search
CPC ..... B65B 57/00; B65B 59/001; B65B 61/22; B65B 55/20
(Continued)

(56) References Cited

U.S. PATENT DOCUMENTS

2001/0017023 A1* 8/2001 Armington ..... B65B 61/22 53/472
2002/0104293 A1* 8/2002 Armington ..... B65B 55/20 53/472
(Continued)

FOREIGN PATENT DOCUMENTS

DE 695 31 061 T2 4/2004
DE 10 2011 055 455 A1 5/2013
(Continued)

OTHER PUBLICATIONS

German Application No. 10 2017 109 736.8 Examination Report dated Feb. 7, 2018.
(Continued)

*Primary Examiner* — Chinyere J Rushing-Tucker
(74) *Attorney, Agent, or Firm* — Wood Herron & Evans LLP

(57) ABSTRACT

The invention relates to a device for cushioning at least one object (12*a-c*) in a container (10*a-c*), comprising a cushioning material provisioning system (19) for the provision of cushioning material (28*a-c*) and a request means (25) which is coupled to the cushioning material provisioning system (19) and which outputs a signal to the cushioning material provisioning system (19) in order to request cushioning material (28*a-c*), the request means (25) allowing acoustic signals, in particular voice signals, to be converted.

11 Claims, 4 Drawing Sheets

(58) Field of Classification Search
USPC ..... 53/473
See application file for complete search history.

(56) References Cited

U.S. PATENT DOCUMENTS

| | | | | |
|---|---|---|---|---|
| 2006/0283155 | A1 | 12/2006 | Haschke | |
| 2010/0326021 | A1* | 12/2010 | Carlson | B65B 55/20 53/474 |
| 2011/0197550 | A1* | 8/2011 | Carlson | B31D 5/0047 53/472 |
| 2016/0009426 | A1* | 1/2016 | Allen | B29C 44/182 141/1 |
| 2017/0183139 | A1* | 6/2017 | Wetsch | G05B 19/41865 |

FOREIGN PATENT DOCUMENTS

| | | | |
|---|---|---|---|
| DE | 10 2012 222 805 | B3 | 6/2013 |
| DE | 10 2012 218 679 | A1 | 4/2014 |
| EP | 2382133 | A1 | 11/2011 |
| EP | 2 268 387 | B1 | 8/2016 |
| JP | 2000250576 | A | 9/2000 |
| WO | 98/56663 | A1 | 12/1998 |
| WO | 2009/117797 | A1 | 10/2009 |

OTHER PUBLICATIONS

PCT/EP2018/061720 International Search Report dated Oct. 10, 2018.
PCT/EP2018/061720 Written Opinion dated Oct. 10, 2018.
EP Application No. 18 724 193.0-1016 Office Action dated Aug. 19, 2021.

* cited by examiner

DEVICE AND METHOD FOR CUSHIONING AT LEAST ONE OBJECT IN A CONTAINER

The invention relates to a device and a method for cushioning at least one object in a container according to the preambles of the two independent claims.

Both from the market and from the patent publications DE 10 2012 222 805 B3 and DE 10 2012 218 679 A1 it is known to cushion objects, by means of crumpled paper, which are present in a container, for example a packaging cardboard, and which are to be transported in the container. The crumpled paper forms a cushioning pad and is made of a web-shaped stock material in a cushioning forming system. After manufacture, the cushioning pad or pads are placed into the container by one person ("packer"). The number and length of cushioning pads are determined by the packer during manufacture, the determination being based on an estimate of the void volume present in the container by the packer.

Moreover, it is also known to use alternative cushioning material, such as so-called "bubble wrap" sheets, in which air cushions trapped in a film material are produced in a cushioning material forming system from a sheet material. Again, the number or the length of the interconnected cushioning pads is determined by the packer.

This applies analogously to other cushioning material, such as cushioning with a variety of foamed moldings, for example, in the form of chips or pellets, etc. Again, the amount of cushioning material to be used is specified by the packer.

For all variants, systems are available on the market in which the packer requests the cushioning material from the cushioning material provisioning system by means of a hand or foot switch.

In particular, when a request is made by means of a manual switch serving as a request means, the packer does not have his hands free at this time, which impairs the speed of packing, especially when further cushioning material needs to be requested. In addition, when using a request means, which is foot-operated, the position of the packer is predetermined, which may not be desirable from an ergonomic point of view.

It is therefore an object of the invention to provide a device and a method of the type mentioned above, which allow a provision of cushioning material in a simple manner.

The object is achieved by a device and a method having the features of the independent claims. Advantageous developments of the invention are specified in the subclaims. In addition, the essential features of the invention are also in the following description and in the accompanying drawings, these features being substantial to the invention both alone and in different combinations.

According to the invention, it is proposed that a device for cushioning at least one object in a container comprises a cushioning material provisioning system for providing cushioning material and a request means coupled to the cushioning material provisioning system and a signal for requesting cushioning material to the cushioning material provisioning system, wherein the request means allows the acoustic signals to be converted.

It is further proposed that a method for cushioning at least one object in a container comprises the following steps:

a) feeding the container to a cushioning material provisioning system, b) transmitting a signal requesting cushioning material via a request means to the cushioning material provisioning system, c) providing the cushioning material based on the transmitted signal, wherein d) a signal is used as an acoustic signal.

In this case, it has been recognized according to the invention that, if an acoustic signal, in particular a speech signal, is used for requesting packaging means, the packaging process experiences the least possible disruption. In particular, if in the course of the packaging process further cushioning material must be requested, the packer does not need to interrupt the packaging process and/or the packer is able to place the object to be packaged in the desired fixed position in the container and/or the packer is able to continue the packaging process with already requested cushioning material until new cushioning material is provided. In addition, the packer is less "statically" tied to his workplace; instead, he is able to change his position easier, than if a foot control is provided, from an ergonomic point of view. As a result, among other benefits, an increase in efficiency can be achieved. In addition, a request via an acoustic signal, in particular a voice signal, is considered a particularly intuitive operating form.

It can be provided that a control and/or regulating system is provided which processes the signals of the request means and causes the provision of the cushioning material.

The cushioning material provisioning system can be designed as both mobile and stationary. If a mobile solution is provided, the flexibility of the site can be increased. In particular, solutions are also conceivable which are suitable for smaller quantities of goods to be packed.

It is particularly preferred if both qualitative and quantitative signals can be transmitted and processed.

Thus, it is generally conceivable to provide only a quantitative processing, wherein a cushioning material provisioning system begins to provide cushioning material in a first acoustic signal, said system terminating its work in a second acoustic signal.

If this is to be converted vocally, for example, by the simple command "Start" and the simple command "Stop," such a solution can be provided. Alternatively, it is also conceivable to provide the same acoustic signal for "Start" and "Stop."

In addition, more complex signals are conceivable, such as numbers, for example "3" based on which then the cushioning material provisioning system provides three (units of) cushioning material. Alternatively, information such as "long," "short" or "3 long" etc. can be converted.

A corresponding device, which in particular includes a voice recognition software, may be part of the request means and/or the control and/or regulating system. In addition, the request means may comprise a microphone.

In a further development, it is proposed that a memory be present in the control and/or regulating system, in which a specific acoustic signal is assigned to a certain type of cushioning material and/or a certain amount of cushioning material, for example in the form of a specific word. Thus, a user may very easily cause the device to provide the desired type of cushioning material and/or the desired amount of cushioning material by using, for example, certain learned keywords.

In a further development, it is proposed that a memory be present in the control and/or regulating system, in which a particular specific acoustic signal, for example in the form of a specific word, is assigned to a certain length and/or a specific degree of filling of a foam-filled cushioning bag. Such foam-filled cushioning bags are known, for example, from WO 2010/076026 A1, the disclosure of which is expressly also made the subject of the present patent application. By means of the present invention, it is possible for a user in a very simple manner to have a padded foam bag provided according to an individual and current need.

Furthermore, according to an advantageous embodiment, it can be provided that the cushioning material provisioning system comprises a cushioning material forming unit, in which the cushioning material is provided by forming a web-shaped starting material. It can be particularly advantageous to use crumpled paper as a cushioning material from which cushioning pads are produced by means of crumpling and cutting to length of the starting material. Crumpled paper is particularly resource-friendly and can be easily produced on site. In this case, the web-shaped starting material can be both rolled up on a roll and folded, for example, as a flat material in a zig-zag. The amount of crumpled paper may be defined by a number and/or length of individual cushioning pads made of crumpled paper.

Alternatively, it is also conceivable to produce gas-filled cushioning bags from a tubular double-layered film material. In this case, a gas-filled bag, preferably an air-filled bag, provided in the film material, is filled by the cushioning material forming system, and then the cushioning bag is closed, for example, by a conventional thermal welding process. The individual cushioning pads can be cut to length from the web material, with it also being possible for several cushioning pads to remain connected to one another via material sections in which no air filling is provided. For easier separability, a perforation can be provided between the individual preformed pads. Here it is also particularly advantageous that the formation of the voluminous cushioning material takes place only on site, and until then, the tube-like film material can be stored assembled as a roll and thus in a space-saving manner. In addition, even when disposing of such a material, it only requires a small space, since the air trapped in the cushioning pad can be easily removed for this purpose.

As an alternative, pockets or bags filled or fillable with expanding foam can also be used as cushioning material. For example, the foam can preferably expand, for example, only at the packing station, so that precisely fitting cushioning solutions can be provided. The bags may be connected to and cut from a web material or provided individually in a prefabricated manner.

In addition, as a further alternative option, loose particular foamed cushioning materials ("loose fill"), which are usually not made on site, however, offer the advantage that they allow a particularly good enclosure of the material to be packaged due to their smaller size. These can then be dosed, for example, in the form of units, wherein a unit can comprise a defined amount of cushioning materials.

A voice control makes it possible to provide the necessary amount of cushioning material as accurately as possible. In this case, the invention makes the knowledge that a packaging scenario, i.e. a predetermined combination of container and object, usually always requires the same amount of cushioning material, so that an experienced packer can request the right amount of cushioning material upon an optical detection of a packaging scenario. In addition, the request is easily possible.

It is particularly preferred according to a development, when a cushioning material is produced, that this is automatically transported immediately after production in the container. This saves time and relieves the packer who is ultimately responsible for packaging the objects in the container. The packer can then do the final positioning.

It is particularly preferred that the cushioning material is transported by gravity into the container. An expensive transport system with a separate drive is thereby avoided, which in turn saves costs.

For example, the cushioning material can be transported along a chute into the container. In this way, a precise and reliable transport is feasible, with reliability and low running costs, due to the lack of drive means.

Hereinafter, an embodiment of the invention will be explained with reference to the accompanying drawings.

In which.

Figure 1:
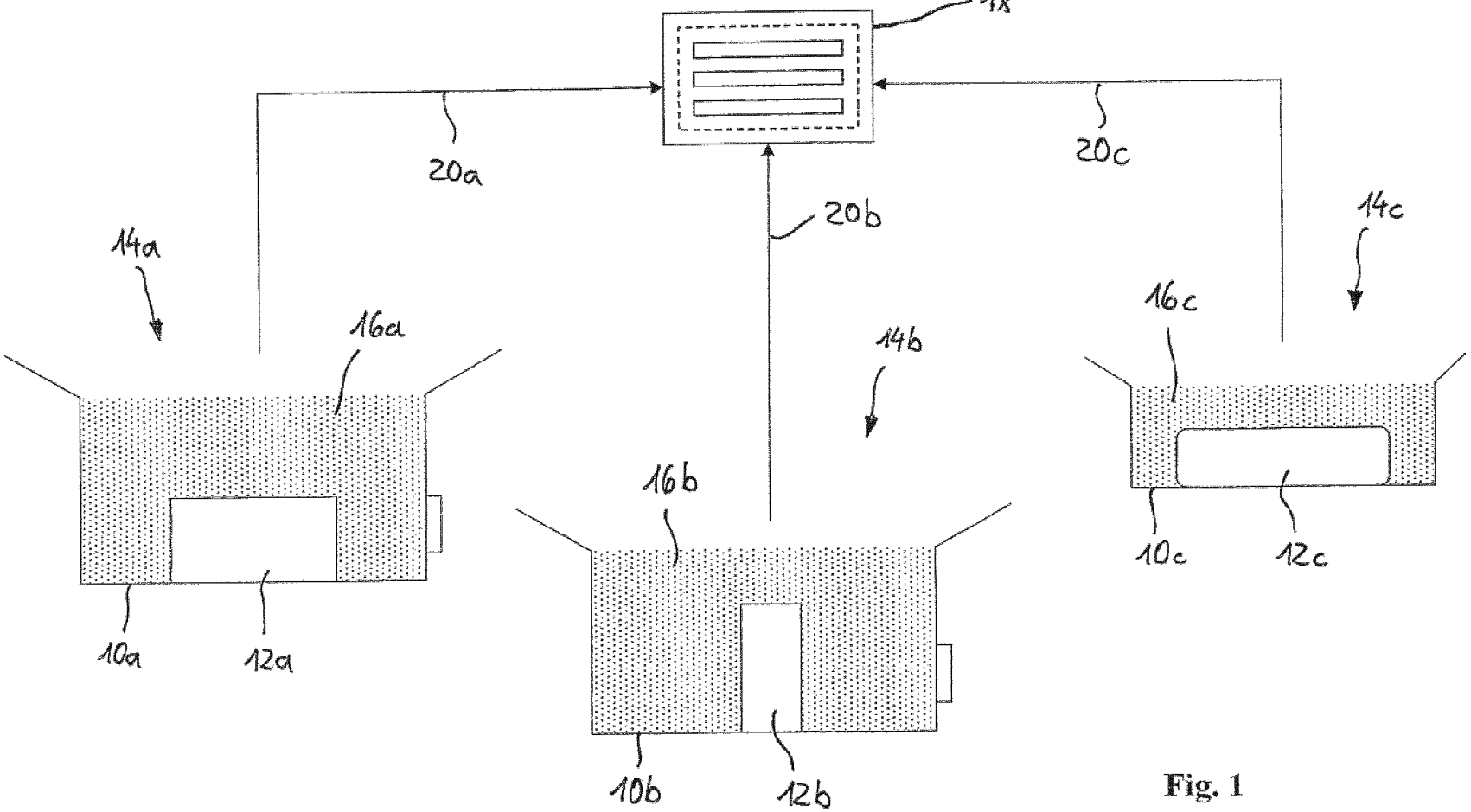
FIG. 1 is a schematic representation showing the determination in advance of an amount of cushioning material for three different packaging scenarios.

In FIG. 1, illustrated containers carry the reference numerals 10*a*, 10*b* and 10*c*. These containers are, for example, containers made of cardboard material, such as those used by mail order companies to ship ordered objects.

In principle, however, the containers can also be containers made of plastic or of another material. It can be seen that the containers 10*a* and 10*b* are identical, whereas the container 10*c* is wider and less high than the containers 10*a* and 10*b*.

In the containers, an object 12*a*, 12*b* and 12*c* is arranged in each case. Although in the present case only a single object 12*a-c* is drawn, in principle it is also conceivable that a plurality of objects are arranged in a container 10*a-c*. It can be seen that the drawn objects 12*a*-12*c* are different. The combination of container 10*a-c* and object 12*a-c* thus defines a very specific packaging scenario 14*a-c*. This is characterized among other things by a certain individual size and also a specific individual distribution of a void volume 16*a-c*, drawn in a dotted manner in the figure, inside the container 10*a-c*, in which the object 12*a-c* is arranged.

For example, via an acoustic signal, which is detected by a request means (not shown), the amount of cushioning material, which is expected by a packer and required for the size of the empty volume 16*a-c* of the specific packaging scenario 14*a-c*, can be communicated to a control and/or regulating system 18, which is indicated in FIG. 1 by respective arrows 20*a-c*. The control and/or regulating system 18 may be, for example, a conventional PC.

In the present case, as will be explained in more detail below, cushioning pads are provided from a crumpled paper material as cushioning material. From the control and/or regulating system 18, the required amount of cushioning material is then requested for a cushioning material provisioning system for each of the packaging scenarios 14*a-c* according to the number of cushioning pads requested by the packer.

All this happens in parallel to the regular packaging of objects in appropriate containers.

It is understood that other cushioning material can be used as the aforementioned cushioning pads. For example, air-filled bags ("airbag"), bags filled with an expanding foam ("foam bag" or else "foam-in-bag") or also so-called "loose-fill" material can be used as cushioning material. Bags filled with an expanding foam are known for example from WO 2010/076026 A1. The detection of the packaging scenario

14*a-c* is carried out by a person, for example by trial and error or experience. For example, in order to transmit the number and dimensions of cushioning pads made of crumpled paper for a particular packaging scenario 14*a-c*, for example via a keyboard (not shown) or via a foot switch to the control and/or regulating system 18, an acoustic signal output is used instead according to the invention, preferably a voice signal. The signal may be, for example, "1 short, 1 medium, 1 long" to request three cushioning pads 28*a-c* of different lengths.

But it is also possible that the type of desired cushioning material and/or the amount of desired cushioning material is assigned a specific keyword. For example, the user may say "Paper 30" to obtain a 30 cm long padded paper cushioning pad. Or he can say "Foam 50 30" to get a 50 cm long bag filled to 30% with expanding foam. Or he simply says "again" to arrange for the provision of the same cushioning material previously provided.

Figure 2:
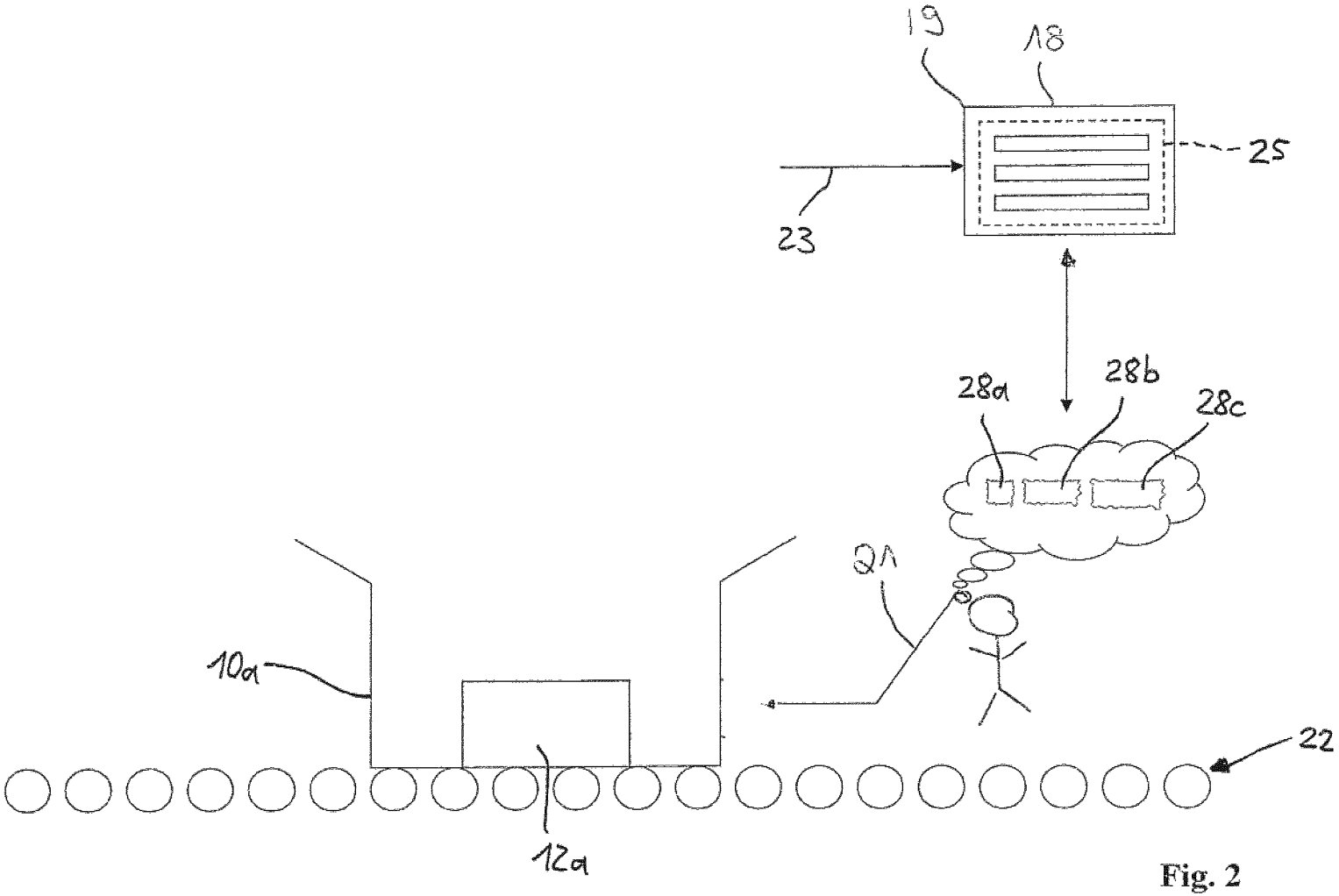
FIG. 2 is a schematic representation showing the provision of a container with information relating to a first packaging scenario of FIG. 1.

Regular packaging of objects in containers will now be explained with reference to FIGS. 2-4. First, it can be seen from FIG. 2 that a container 10*a* with an object 12*a* is transported on a roller conveyor 22. One person ("packer") now evaluates which packaging scenario is involved (arrow 21). The packer now requests the required number and amount of cushioning material (28*a*-28*c*) by means of the speech signal (arrow 23) in the cushioning material provisioning system 19 which includes the control and/or regulating system 18 (e.g. 1×short, 1×middle, 1×long). In the control and/or regulating system 18, a corresponding speech recognition is provided for this purpose, with which a request means 25 having a microphone is coupled.

Figure 3:
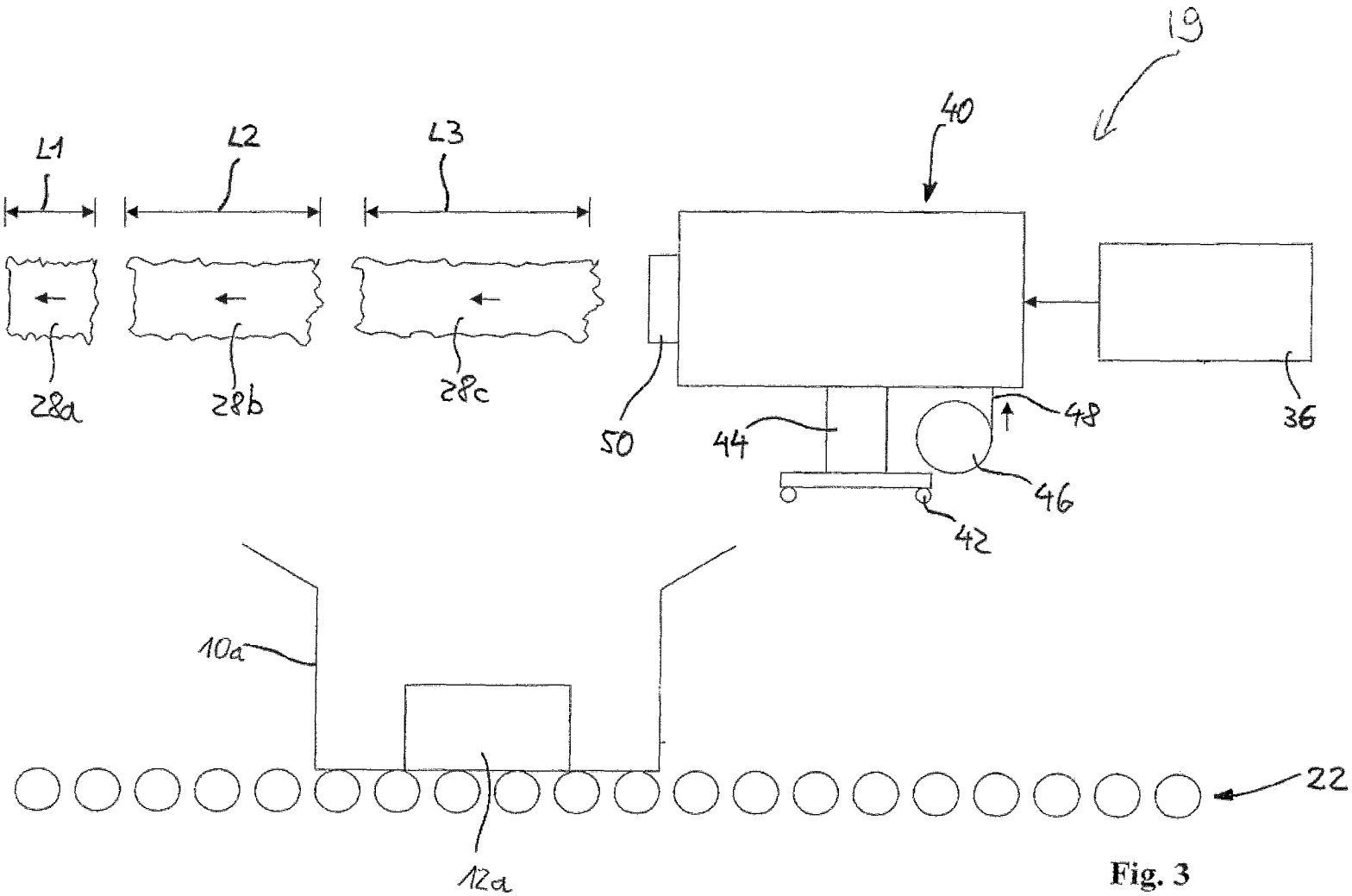
FIG. 3 is a schematic representation showing a provision of cushioning material for the packaging scenario of FIG. 2.

At the cushioning material provisioning system 19, the cushioning material, in the present case the cushioning pads 28*a-c*, are provided (FIG. 3). As mentioned, this information transmitted via the signal is the number and length of cushioning pads 28*a-c* to be provided.

In addition to the control and/or regulating system 18, a cushioning material forming system 40 belongs to the cushioning material provisioning system (18). The cushioning material provisioning system 19 may be stationary, but it may also be a mobile system. In the present case, this is indicated by the cushioning forming system 40 comprising a stand 44 which can be moved by means of rollers 42.

The control and/or regulating system 18 activates the cushioning forming system 40 in such a way that the 3 cushioning material items 28*a*, 28*b* and 28*c* mentioned above are produced and thus provided by machine crumpling from a web-shaped paper starting material 48 currently stored on a roll 46 (it is understood that the web-shaped paper starting material could also be stored as a zig-zag folded stack instead of on a roll). These cushioning pads 28*a-c* differ in their length, which is L1 in the cushioning pad 28*a*, L2 in the cushioning pad 28*b*, and L3 in the cushioning pad 28*c*. The cushioning pads 28*a-c* are output from the cushioning forming system 40 from a machine outlet 50.

Figure 4:
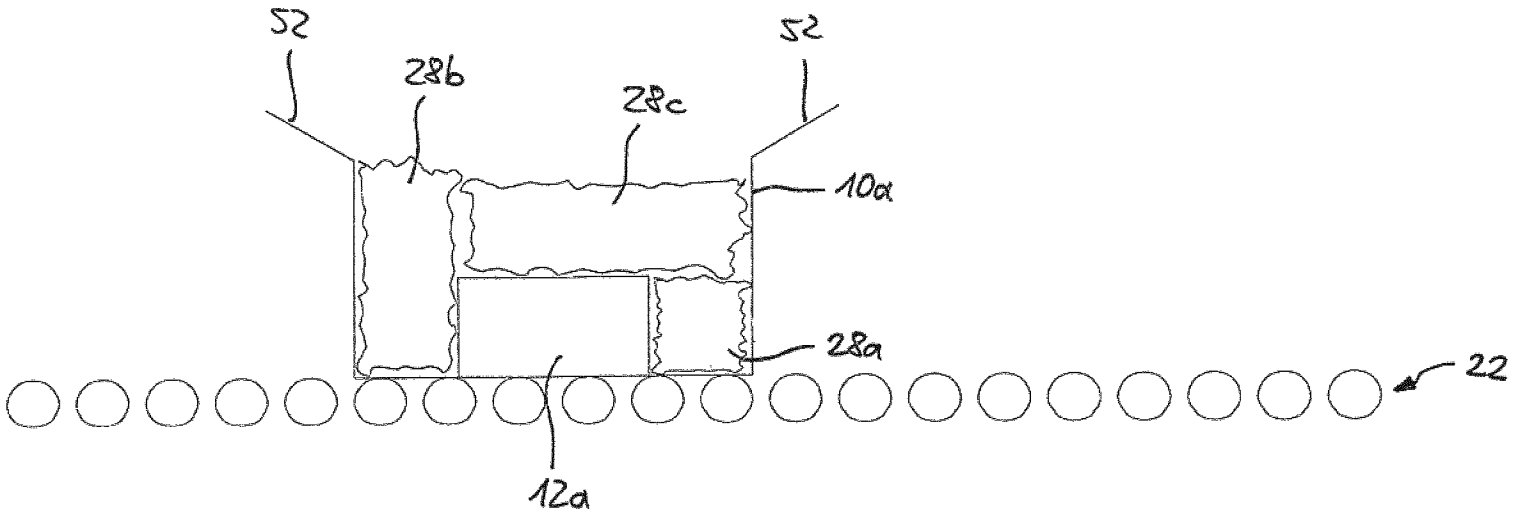
FIG. 4 shows a schematic representation of the container, object and cushioning material of the packaging scenario of FIG. 2.

A person now takes the produced cushioning pads 28*a-c* and places them, as shown in FIG. 4, in the void volume 16*a* so that it is adequately filled and the object 12*a* is adequately protected against both slipping and external damage due to the forces acting on the container 10*a*. The container 10*a* can now be closed and transported by folding flaps 52.

The invention claimed is:

1. A device for cushioning at least one object in a container, comprising:

a cushioning material provisioning system for providing cushioning material, a request means, coupled to the cushioning material provisioning system, and configured to detect voice commands and to transmit signals in response thereto, a controller configured to receive the signals from the request means and to send signals to the cushioning material provisioning system, and a memory configured to be accessed by the controller and to associate each of a plurality of voice commands with an amount of cushioning material, whereby a user, by visual inspection, determines the amount of cushioning material required to fill an empty volume of the container, and verbally commands the device to produce that amount of cushioning material, without providing container characteristic information to the controller and without providing a relative degree to which the container has been filled by one or more objects to be packaged to the controller.

2. The device according to claim 1, wherein qualitative and/or quantitative signals can be transmitted and processed with the controller.

3. The device according to claim 1, wherein the cushioning material provisioning system comprises a cushioning material forming system which converts a web-shaped paper starting material into crumpled cushioning pads or a tubular film material into gas-filled or foam-filled cushioning bags.

4. The device according to claim 3, wherein a certain length and/or a certain degree of filling of a foam-filled cushioning bag is assigned to a respective particular acoustic signal in the form of a specific word.

5. The device according to claim 1, wherein the request means comprises a microphone.

6. A method for cushioning at least one object in a container by the following steps:

a) supplying the container to a cushioning material provisioning system, b) transmitting a signal representing a word said by a user for requesting cushioning material via a request means to the cushioning material provisioning system, c) providing the cushioning material based on the transmitted signal, d) providing a memory in a control and/or regulating system, and e) assigning a certain length of cushioning material to the word and storing the length and the word in the memory, whereby the user:

communicates to the control and/or regulating system the word, and causes the device to provide the certain length of cushioning material, without providing container characteristic information to the control and/or regulating system and without providing a relative degree to which the container has been filled by one or more objects to be packaged to the control and/or regulating system.

7. The method according to claim 6 wherein a speech signal is used.

8. The method according to claim 7, wherein the speech signal also defines the type of cushioning material.

9. The method according to claim 6, wherein the provision of the cushioning means takes place by forming a web-like starting material, in particular a paper material, into crumpled cushioning pads, or by forming a tubular material, in particular a film material, into gas-filled or foam-filled cushioned bags.

10. The method according to claim 9, wherein the amount of cushioning material provided is defined by the number and the length of the cushioning pads.

11. A device for cushioning at least one object in a container, comprising:

a cushioning material provisioning system for providing cushioning material, a request means, coupled to the cushioning material provisioning system, and configured to detect voice commands and to transmit signals in response thereto, a controller configured to receive the signals from the request means and to send signals to the cushioning material provisioning system, and a memory configured to be accessed by the controller and to associate each of a first plurality of voice commands with a type of cushioning material and to associate each of a second plurality of voice commands with an amount of cushioning material, whereby a user, by visual inspection, determines the type and amount of cushioning material required to fill an empty volume of the container, and verbally commands the device to produce that amount of that type cushioning material, without providing container characteristic information to the controller and without providing a relative degree to which the container has been filled by one or more objects to be packaged to the controller.

* * * * *